US011591144B2

(12) United States Patent
Paganuzzi et al.

(10) Patent No.: US 11,591,144 B2
(45) Date of Patent: Feb. 28, 2023

(54) CAPSULE FOR CLOSING A CONTAINER

(71) Applicant: BORMIOLI PHARMA S.P.A., Milan (IT)

(72) Inventors: Valerio Paganuzzi, Parma (IT); Roberto Valenti, Collecchio (IT)

(73) Assignee: BORMIOLI PHARMA S.P.A., Milan (IT)

( * ) Notice: Subject to any disclaimer, the term of this patent is extended or adjusted under 35 U.S.C. 154(b) by 250 days.

(21) Appl. No.: 16/961,989

(22) PCT Filed: Jan. 23, 2019

(86) PCT No.: PCT/IB2019/050565
§ 371 (c)(1),
(2) Date: Jul. 14, 2020

(87) PCT Pub. No.: WO2019/155312
PCT Pub. Date: Aug. 15, 2019

(65) Prior Publication Data

US 2021/0078779 A1 Mar. 18, 2021

(30) Foreign Application Priority Data

Feb. 8, 2018 (IT) ..... 102018000002518

(51) Int. Cl.
*B65D 51/28* (2006.01)
*B65D 51/30* (2006.01)

(52) U.S. Cl.
CPC ..... *B65D 51/285* (2013.01); *B65D 51/30* (2013.01)

(58) Field of Classification Search
CPC .... B65D 2585/56; B65D 51/28; B65D 51/26; B65D 47/148; B65D 47/0885;
(Continued)

(56) References Cited

U.S. PATENT DOCUMENTS 2,073,273 A * 3/1937 Korn ..... B01F 23/23611 426/477
3,840,136 A * 10/1974 Lanfranconi ..... B65D 51/226 222/83.5
(Continued)

FOREIGN PATENT DOCUMENTS

CN 106414268 A 2/2017
JP 2004238022 A 8/2004
(Continued)

*Primary Examiner* — Ernesto A Grano
(74) *Attorney, Agent, or Firm* — Pearne & Gordon LLP; Bryan M. Gallo

(57) ABSTRACT

A closure capsule for closing a container, comprising: —a cap (2) that can be associated with a container and comprising a frangible mouth (20); —a cutter (3) comprising a cutting edge (30) designed to open said frangible mouth (20) which assumes a first configuration in which it is intact and a second configuration in which it is open; —a covering (4) of the cap (2) and the cutter (3); in the first configuration at least the cap (2) and the cutter (3) define a tank (8) for containing a product destined to be dropped into the container in said second configuration; —transmission means (5) for transmitting a rotary component from the covering (4) to the cutter (3); —moisture absorbing means (10) which surmount at least one portion of said cutter (3).

9 Claims, 3 Drawing Sheets

(58) Field of Classification Search
CPC ..... B65D 23/00; B65D 51/285; B65D 51/30; B65D 2401/25; B65D 51/20; B65D 2401/15; B65D 2401/20
USPC ..... 215/257; 220/212
See application file for complete search history.

(56) References Cited

U.S. PATENT DOCUMENTS 4,982,875 A * 1/1991 Pozzi ..... B65D 81/3222 604/416
5,927,549 A * 7/1999 Wood ..... B65D 51/285 222/129
6,148,996 A * 11/2000 Morini ..... B65D 51/285 215/DIG. 8
6,705,462 B2 * 3/2004 Kasuya ..... B65D 25/08 215/DIG. 8
8,215,481 B1 * 7/2012 Knickerbocker .... B65D 51/285 215/DIG. 8
8,408,389 B1 4/2013 Anderson
9,242,773 B1 1/2016 Anderson
9,834,351 B2 12/2017 Benedetti et al.
2002/0020636 A1 * 2/2002 Bergamini ..... A61J 1/2093 206/219
2005/0161348 A1 * 7/2005 Morini ..... B65D 51/285 206/219
2006/0108314 A1 * 5/2006 Cho ..... B65D 51/285 215/253
2008/0093326 A1 * 4/2008 Cho ..... B65D 51/285 206/222
2008/0142473 A1 * 6/2008 Cho ..... B65D 51/285 215/329
2008/0202949 A1 * 8/2008 Morini ..... B65D 51/285 206/219
2010/0059394 A1 * 3/2010 Fontana ..... B65D 81/3222 206/219
2010/0116699 A1 * 5/2010 Sorenson ..... B65D 51/285 206/219
2010/0282624 A1 * 11/2010 Paganuzzi ..... B65D 51/285 206/222
2011/0147414 A1 * 6/2011 Chen ..... B65D 51/285 222/83
2012/0325697 A1 * 12/2012 Cho ..... B65D 51/285 206/219
2013/0105433 A1 * 5/2013 Chen ..... B65D 51/2835 29/434
2013/0313138 A1 * 11/2013 Thoman ..... B65D 51/285 206/222
2014/0017363 A1 * 1/2014 Aibe ..... A23L 29/231 426/115
2014/0048507 A1 * 2/2014 Brambilla ..... B65D 51/30 215/257
2015/0203261 A1 * 7/2015 Lee ..... B65D 1/0246 206/219
2015/0239638 A1 * 8/2015 Lee ..... B65D 39/08 206/219
2016/0264323 A1 * 9/2016 Jeon ..... B65D 51/243
2017/0057712 A1 3/2017 Benedetti et al.
2018/0208372 A1 * 7/2018 Rovelli ..... B65D 51/285
2018/0362229 A1 12/2018 Paganuzzi et al.

FOREIGN PATENT DOCUMENTS

JP 2012012030 A 1/2012
WO 2017109599 A1 6/2017

* cited by examiner

CAPSULE FOR CLOSING A CONTAINER

TECHNICAL FIELD

The object of the present invention is a closure capsule for closing a container and a method for assembling said capsule.

STATE OF THE ART

A safety capsule with a frangible tank is known as described in patent WO2017/109599. This capsule comprises:

- a cap which closes a mouth of a container and comprises a frangible base;
- a cutter destined to open said frangible mouth following a rotation-translation induced by pressure acting on the same; the cutter is hollow and in combination with the frangible mouth defines a tank that receives in its interior a solute destined to dissolve in the solvent present in the container;
- a covering that protects both said capsule and said cutter and comprises a security strip that must be removed in order to break the frangible base, mixing the solute and solvent. After having removed the security strip, the initial screwing of the covering onto the cap pushes the cutter, causing the opening of the frangible mouth.

A drawback to which these types of capsules are subject is the deterioration of the solute caused by moisture.

In the above solution the cutter comprises in particular a widening of the transversal section that makes it possible to receive larger amounts of solute. This makes this capsule particularly exposed to the problem of the product's deterioration due to moisture. In fact the solute volumes are greater, like the surfaces delimiting the tank and protecting it from the entrance of moisture.

OBJECT OF THE INVENTION

The object of the present invention is to propose a closure capsule of a container and a method for assembling said closure capsule which overcome the above-illustrated drawbacks.

The set technical task and the specified objects are substantially attained by a closure capsule of a container and its assembly method, comprising the technical characteristics as set out in one or more of the accompanying claims.

BRIEF DESCRIPTION OF THE DRAWINGS

Further characteristics and advantages of the present invention will become more apparent from the following indicative and therefore non-limiting description of a closure capsule of a container as illustrated in the appended drawings, in which.

DETAILED DESCRIPTION OF PREFERRED EMBODIMENTS OF THE INVENTION

Figure 1:
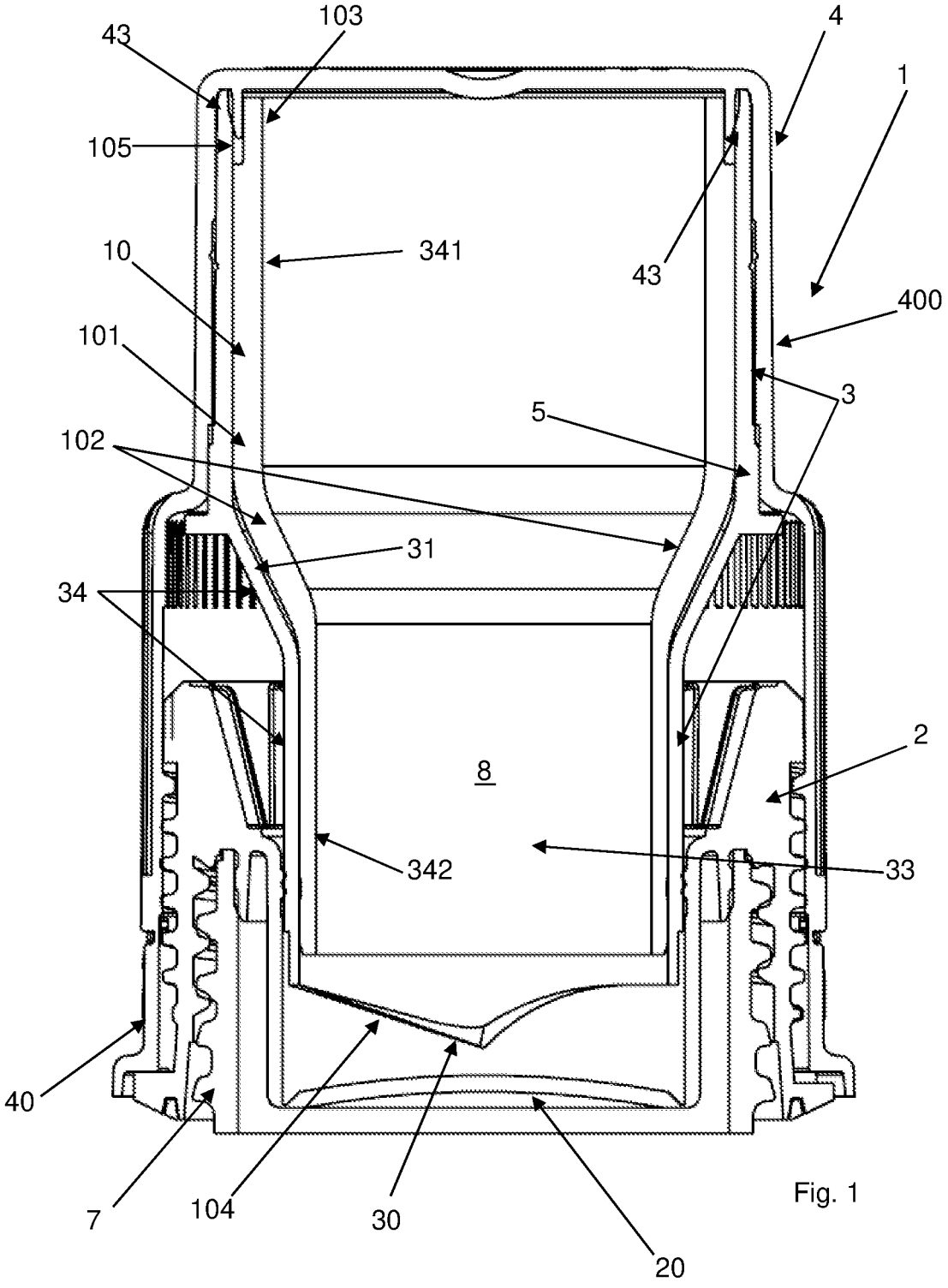
FIG. 1 is a section view of a capsule according to the present invention.

In the appended figures, reference number 1 denotes a closure capsule for closing a container.

The capsule 1 comprises a cap 2 that can be associated with a container. In particular, the cap 2 can be associated with a mouth of the container. In this regard the cap 2 comprises an inner annular surface comprising a threading 21 suitable to interact with a corresponding threading fashioned on the container. Suitably the cap 3 comprises an annular seat 32 designed to receive an end of the mouth of the container.

The cap 2 further comprises a frangible mouth 20.

The capsule 1 further comprises a cutter 3. The cutter 3 comprises a cutting edge 30 designed to open the frangible mouth 20 which assumes a first configuration (see FIG. 1 or 4) in which it is intact and a second configuration in which it is open.

The capsule 1 comprises a covering 4 of the cap 2.

The covering 4 protects both said cap 2 and said cutter 3. Suitably both the covering 4 and the cutter 3 are made of plastic.

The covering 4 makes it possible to avoid a user managing to unscrew the cap 2 without first having broken the frangible mouth 20 through the cutter 3.

The covering 4 suitably comprises a security strip 40. The security strip 40 must be removed to allow the opening of the container closed by the capsule 10.

In a configuration wherein said frangible mouth 20 is intact (the first configuration) at least the cap 2 and the cutter 3 define a tank 8 for containing a product designed to be dropped into the container in said second configuration.

In the first configuration the cap 2, the cutter 3 and the covering 4 contribute to define the walls of the tank 8.

The product in the tank 8 is advantageously powdered or granular material. This product is a solute intended to dissolve in a substance (solvent) contained in the container (identified with reference number 7 in the figures). The cutter 3 and the covering 4 are physically distinct pieces. Advantageously the cutter 3 is a single piece. The cutter 3 is a body that defines a cavity 33 internally in which it is possible to house at least one part of the product (solute). Similarly the cap 2 is a single piece.

The capsule 1 further comprises transmission means 5 for transmitting a rotary component of a movement of the covering 4 to the cutter 3. This rotary component is part of a rotation-translation that involves at least one movement of the cutter 3 from the first to the second configuration and even beyond.

Figure 2:
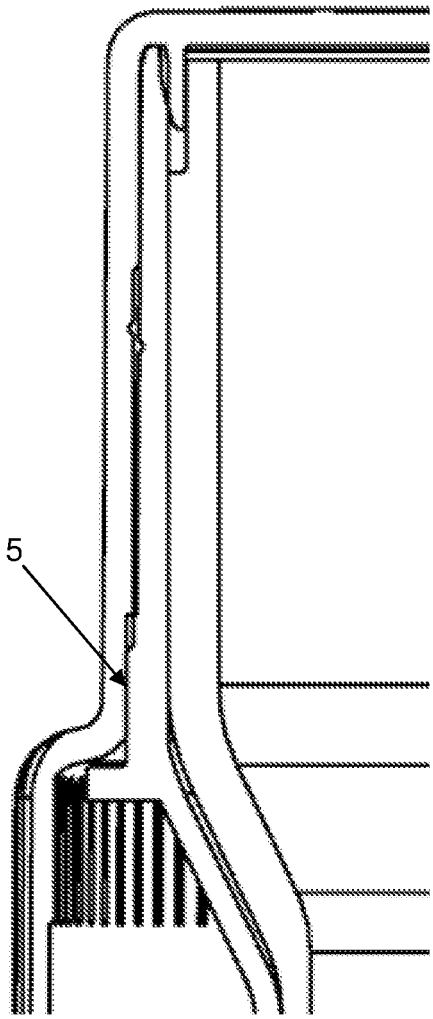
FIGS. 2 and 3 show enlargements of details of FIG. 1.
Figure 3:
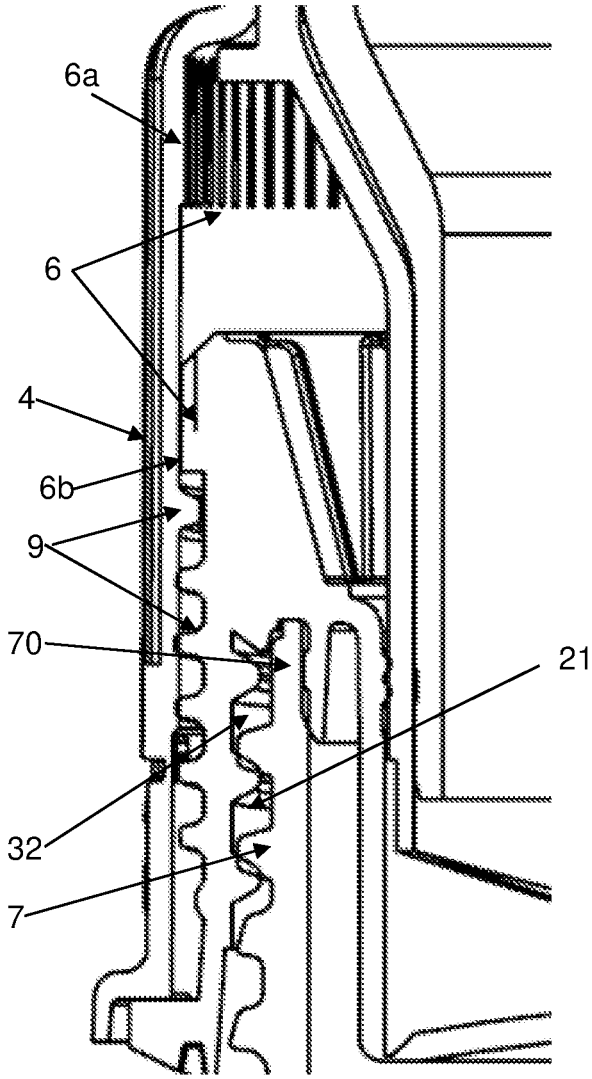

The transmission means 5 are toothed. They are fashioned on the covering 4 and on the cutter 3. In particular, the transmission means 5 comprise a first part fashioned on a surface of the covering 4 (suitably turned inwards) and a second part fashioned on a surface of the cutter 3 (suitably turned outwards) which mutually face each other. The transmission means 5 mutually interact with each other and in this way make said cutter 3 and at least a first part 400 of the covering 4 integral in rotation (advantageously the entire covering 4, as in the case of the solution of FIGS. 1-3).

The capsule 1 also comprises threaded connecting means 9 that couple the covering 4 and the cap 2, thereby allowing a rotation-translation of the first part 400 of the covering 4 and the cutter 3 with respect to said cap 2, passing at least from the first configuration to the second configuration. Advantageously, the second configuration is assumed at least at an end-stroke of the rotation-translation of the first part 400 of the covering 4 and the cutter 3 with respect to the cap 2 (distancing from the first configuration).

The cutter 3 also comprises a widening zone 31, wherein, as it moves away from the cutting edge 30, the transversal section of the cutter 3 increases.

Advantageously, the capsule 1 comprises moisture absorbing means 10 that overlap/surmount at least one portion of the cutter 3.

The absorbing means 10 comprise for example calcium oxide or zeolite. The moisture absorbing means 10 comprise a tubular portion 101. This tubular portion 101 internally overlaps the cutter 3. The tubular portion 101 has a widening 102 of a section that follows said widening zone 31 of the cutter 3.

The tubular portion 101 is integrated in a tubular member open at two opposite ends 103, 104 thereof.

Preferably, the tubular portion 101 has a thickness smaller than 3 millimetres.

The cutter 3 comprises a longitudinal shank 34 at an end of which the cutting edge 30 extends. The moisture absorbing means 10 extend for at least 75% of the longitudinal extension of the shank 34.

The cutter 3 and the tubular portion 101 are connected by friction-coupling, The cutter 3 radially compresses at least one portion of the tubular portion 101, holding it in position.

As indicated above, the widening zone 31 determines a widening of the transversal section of the tank 8. This "transversal" section is evaluated with respect to an axial direction of screwing of the covering 4 on the cap 2. In particular, there is a widening of the section of the cutter 3 which is orthogonal to the axial direction of screwing of the covering 4 on the cap 2. As shown by way of example in the appended figures, the widening zone 30 is a countersink.

The widening zone 31 makes it so the tank 8 cannot be delimited at the top by the cutter 3 due to problems related to the fact that such a piece is made by moulding. The covering 4 and cutter 3 are however in direct contact to minimise the possible deterioration of the solute present in the tank 8 caused by moisture.

The movement of the cutter 3 from the first to the second configuration is controlled by the screwing of the covering 4 along the cap 2.

The passage from the first configuration to the second configuration is associated with a cutting of the frangible mouth 20 that defines an arc of circumference that subtends an angle at the centre comprised between 250° and 300°, in particular comprised between 260° and 280°. This makes it possible to cut the frangible mouth 20 without running the risk that the same can fall inside the container (and would in fact prevent the subsequent extraction of the product present in the container). In this regard, one end of the cutter 3 comprises a circular perimeter and the cutting edge 30 involves less than 25% of said perimeter; the remaining parts of the perimeter extend along a same imaginary plane (which is advantageously orthogonal to the line of movement of the cutter 3).

The covering 4 defines an annular groove 43 into which one end of the cutter 3 is inserted that is located on the opposite side with respect to the cutting edge 30. The tubular portion 101 comprises a narrowing 105 of thickness which enables accommodating said seating 43.

The capsule 1 comprises toothed coupling means 6 which at the stroke-end of the rotation-translation of the cutter 3 in the distancing direction from the first configuration make said first part 400 of the covering 4 and said cap 2 integral in rotation. The coupling means 6 are fashioned on the covering 4 and on the cap 2.

This makes it possible to open and close the capsule like a normal cap once the solute present in the tank 8 has been released inside the container. In fact, the coupling means 6 are such that at the rotation-translation end-stroke of the cutter 3 in the distancing direction from the first configuration, a rotation applied by a user on the covering 4 determines the unscrewing/screwing of the cap 2 with respect to the container.

Figure 4:
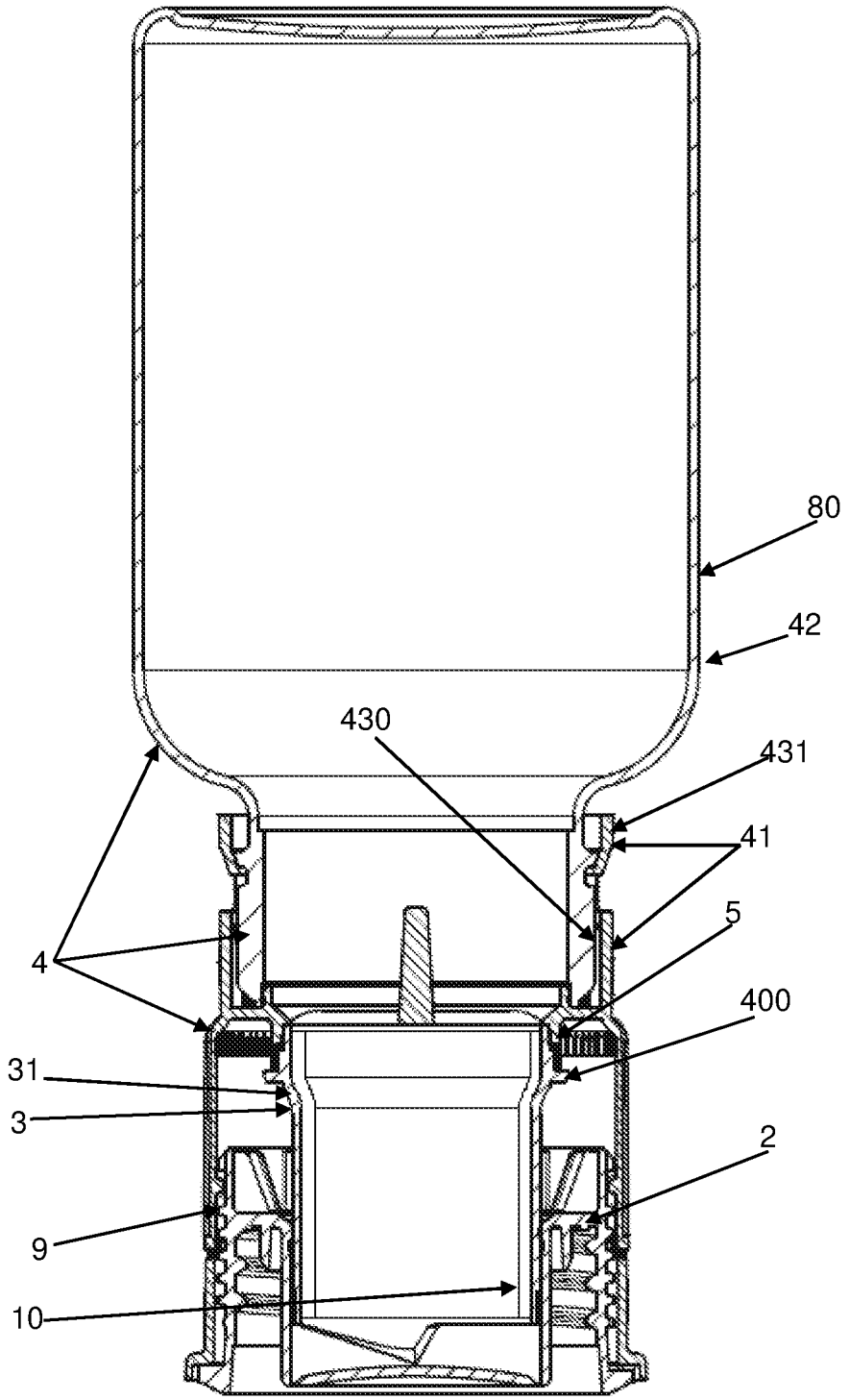
FIG. 4 shows a further embodiment of a capsule according to the present invention.

Please refer now to the solution exemplified in FIG. 4.

The covering 4 comprises a first portion 41, in turn comprising a part of the transmission means 5.

The covering 4 also comprises a second portion 42 removably connected to said first portion 41 (for example by threaded connection means or by a press-fit engagement). The first and second portions 41, 42 can be connected in such a way as to make them integral in rotation (by way of example, but not limited to, knurled elements 430 placed on the first and second portion 41, 42 and interacting with each other). Furthermore, the first portion 41 can comprise an elastically deformable element (ring) 431 that allows the insertion of the second portion 42, preventing the extraction.

The second portion 42 comprises a receptacle 80 which helps to define said tank 8. Appropriately this receptacle 80 is a single body. It has an inlet opening facing towards said cutter 3. Advantageously, the inlet opening of the receptacle 80 extends inside the first portion 41 of the covering 4. In the exemplary solution of FIG. 4, the tank 8 has a volume greater than 100 $cm^3$. In the solution of FIG. 1, the tank 8 has a volume less than 50 $cm^3$.

The object of the present invention is also a system comprising:

- a container 7 for a liquid, comprising a mouthpiece 70;
- a capsule 1 having one or more of the characteristics described above;

the cap 2 of the capsule 1 is connectable to the mouthpiece 70 of the container 7.

Further subject matter of the present invention is an assembly method of a closure capsule having one or more of the characteristics described hereinabove.

The method conveniently comprises the steps of:

- inserting a sleeve defining said tubular portion 101 inside the cutter 3, said cutter 3 comprising a first and a second part 341, 342 between which said widening zone 31 is interposed, said first part 341 having a greater transversal section than said second part 342; the insertion of the sleeve taking place from said first part 341 and determining a transversal narrowing of a portion of the sleeve which extends into said second part 342;
- connecting an end of the cutter 3 to the covering 4;
- inserting in the cutter 3 the product to be dropped into the container 7 following breakage of the frangible mouth 20;
- connecting the cutter 3 and the covering 4 with the cap 2, advantageously inserting at least an annular part of the cap 2 between the cutter 3 and the covering 4.

The following briefly illustrates a method of opening the capsule 1 illustrated in FIG. 1.

The method comprises the steps of:

- removing the security strip 40 (advantageously this step envisages tearing the security strip 40, which is advantageously connected to the remaining parts of the covering 4 by means of connecting bridges);
- cutting said frangible mouth 20, causing a substance present in a tank 8 defined at least by the combination of the cutter 3, the covering 4 and the frangible mouth 20 to drop into the container 7. In this way the mixing of the substance (solute) present in the tank 8 with the solvent present in the container 7 is obtained.

The step of cutting the frangible mouth 20 comprises the step of screwing at least a first part 400 of the covering 4 along the cap 2, determining a rotation-translation of the cutter 3. As described with reference to the first part 400 of the covering 4, it can be advantageously extended to the entire covering 4 (once the security strip has been removed, the covering 4 can be a single monolithic body or an assembly of several pieces).

The cutter 3 and at least a first part 400 of the covering 4 are in fact integral in rotation with the transmission means 5. Furthermore, the screwing of the first part 400 of the covering 4 along the cap 2 also determines a thrust of the covering 4 on the cutter 3.

The step of cutting said frangible mouth 20 envisages cutting the frangible mouth 20 along an arc of a circumference that subtends an angle at the centre comprised between 250° and 320°, leaving one edge of the frangible mouth 20 connected to the remaining parts of the cap 2.

The method also comprises the step of mutually engaging the toothed coupling means 6 fashioned in part 6*a* on the covering 4 and in part 6*b* on the cap 2, making integral in rotation-translation the first part 400 of the covering 4 and the cap 2 such that the cap 2 and the first part 400 of the covering 4 remain integral during the screwing and unscrewing of the cap 2 with respect to the container 7. In this way, the capsule 1 can now be screwed/unscrewed repeatedly with respect to the container 7.

The step of mutually engaging the toothed coupling means 6 occurs at the end of the step of screwing said covering 4 along the cap 2.

The present invention achieves the important advantage of providing capsules having capacious tanks to contain the solute, protecting it from moisture.

The invention as it is conceived is susceptible to numerous modifications and variations, all falling within the scope of the inventive concept characterising it. Furthermore, all the details can be replaced with other technically-equivalent elements. In practice, all the materials used, as well as the dimensions, can be any according to requirements.

The invention claimed is:

1. A closure capsule for closing a container, comprising:

a cap (2) that can be associated with a container and comprising a frangible mouth (20);

a cutter (3) comprising a cutting edge (30) designed to open said frangible mouth (20) which assumes a first configuration in which it is intact and a second configuration in which it is open;

the cutter (3) also comprising a widening zone (31), wherein, as it moves away from the cutting edge (30), the transversal section of the cutter (3) increases;

a covering (4) of the cap (2) and the cutter (3);

in the first configuration at least the cap (2) and the cutter (3) define a tank (8) for containing a product destined to be dropped into the container in said second configuration;

transmission means (5) for transmitting a rotary component from the covering (4) to the cutter (3);

characterised in that it comprises moisture absorbing means (10) which overlap at least a portion of said cutter (3);

said moisture absorbing means (10) comprising a tubular portion (101) which superposes internally of the cutter (3) and has a widening (102) of a section thereof which follows said widening zone (31) of the cutter (3); the tubular portion (101) has a thickness smaller than 3 millimetres.

2. The capsule according to claim 1, characterised in that the tubular portion (101) is integrated in a tubular member opened at two opposite ends (103, 104) thereof.

3. The capsule according to claim 1, characterised in that said cutter (3) and said tubular portion (101) are connected by friction-coupling, said cutter (3) radially compressing said tubular portion (101) and retaining it in place.

4. The capsule according to claim 1, characterised in that said covering (4) comprises a seating (43) into which an end of the cutter (3) opposite the cutting edge (30) is inserted; said tubular portion (101) comprising a narrowing (105) of thickness which enables accommodating said seating (43).

5. The capsule according to claim 1, characterised in that said cutter (3) comprises a longitudinal shank (34) at an end of which the cutting edge (30) extends; said moisture absorbing means (10) extending for at least 75% of the longitudinal extension of said shank (34).

6. The capsule according to claim 1, characterised in that in the first configuration the cap (2) the cutter (3), and the covering (4) contribute to define walls of the tank (8) for containing a product destined to be dropped into the container in the second configuration.

7. The capsule according to claim 1, characterised in that the transmission means (5) are toothed and are fashioned at least in the covering (4) and in the cutter (3), enabling said cutter (3) and at least a first part (400) of said covering (4) to be made integral in rotation;

said capsule comprising threaded connecting means (9) that couple the covering (4) and the cap (2), thereby determining rotation-translation of the first part (400) of the covering (4) and the cutter (3) with respect to said cap (2).

8. The capsule according to claim 7, characterised in that it comprises toothed coupling means (6) which at a stroke end of the rotation-translation of the cutter (3) in the distancing direction from the first configuration make said first part (400) of the covering (4) and said cap (2) integral in rotation.

9. A method for assembling a closure capsule according to claim 1, characterised in that it comprises the steps of:

inserting a sleeve defining said tubular portion (101) internally of the cutter (3), said cutter (3) comprising a first and a second part (341, 342) between which said widening zone (31) is interposed, said first part (341) having a transversal section bigger than said second part (342);

the inserting of the sleeve taking place from said first part (341) and determining a transversal narrowing of a portion of the sleeve which extends into said second part (342);

connecting an end of the cutter (3) to the covering (4);

inserting in the cutter (3) the product to be dropped into the container (7) following breakage of the frangible mouth (20);

connecting the cutter (3) and the covering (4) with the cap (2), inserting at least an annular part of the cap (2) between the cutter (3) and the covering (4).

* * * * *